US010377024B2

(12) United States Patent
Huang

(10) Patent No.: US 10,377,024 B2
(45) Date of Patent: Aug. 13, 2019

(54) TOOL WITH QUICK-RELEASE DRILL BITS

(71) Applicant: Shi-Yi Huang, Changhua (TW)

(72) Inventor: Shi-Yi Huang, Changhua (TW)

( * ) Notice: Subject to any disclaimer, the term of this patent is extended or adjusted under 35 U.S.C. 154(b) by 342 days.

(21) Appl. No.: 15/299,151

(22) Filed: Oct. 20, 2016

(65) Prior Publication Data

US 2018/0111254 A1 Apr. 26, 2018

(51) Int. Cl.
*B25B 23/00* (2006.01)

(52) U.S. Cl.
CPC ..... *B25B 23/0035* (2013.01)

(58) Field of Classification Search
CPC ..... B25B 23/0035; B23B 31/1074
USPC ..... 81/177.2, 437
See application file for complete search history.

(56) References Cited

U.S. PATENT DOCUMENTS 2,474,360 A * 6/1949 Jimerson ..... B25B 23/0035 279/76
2004/0118254 A1* 6/2004 Chen ..... B25B 23/0021 81/177.85
2010/0101380 A1* 4/2010 Chen ..... B25B 13/06 81/437
2011/0100168 A1* 5/2011 Chi ..... B25B 23/0028 81/177.85
2013/0333527 A1* 12/2013 Su ..... B25B 23/0007 81/177.2
2014/0097582 A1* 4/2014 Wang ..... B25B 23/0021 279/145
2014/0197609 A1* 7/2014 Chen ..... B23B 31/1074 279/97
2014/0318327 A1* 10/2014 Yang ..... B25B 23/0035 81/437
2015/0135504 A1* 5/2015 East ..... B25B 13/102 29/426.5

* cited by examiner

*Primary Examiner* — David B. Thomas
(74) *Attorney, Agent, or Firm* — Che-Yang Chen; Law Offices of Scott Warmuth

(57) ABSTRACT

A tool assembly for screwdriver with quick-release drill bits includes a bit main body, a sliding sleeve, a spring and a locating bolt. The bit main body has a shaft, and an outer periphery of a front end of the shaft has a plurality of axial cutting surfaces to form a connecting portion with a polygonal cross section. The sliding sleeve comprises a rear end and a front end, and a driving hole with a polygonal cross section axially penetrates through the sliding sleeve. An engaging groove formed at an inner periphery of the driving hole is located adjacent to the rear end of the sliding sleeve. The spring, the locating bolt and the engaging groove are configured to effectively shorten lengths of the connecting portion of the main body and the sliding sleeve thus lowering the manufacturing cost and increasing the competitive advantage in the market.

10 Claims, 12 Drawing Sheets

TOOL WITH QUICK-RELEASE DRILL BITS

FIELD OF THE INVENTION

The present invention relates to a tool assembly, and more particularly to a tool assembly with quick-release drill bits.

BACKGROUND OF THE INVENTION

Referring to FIGS. 8 to 10, a conventional tool assembly for screwdriver with detachable drill bits has a connecting rod (70), a sliding sleeve (80) and a C-shaped fastener (90). The connecting rod (70) comprises a circular shaft (71), and a first end thereof has a hexagonal connecting portion (72). An annular groove (73) formed on a surface of the connecting portion (72) is configured to connect with an electric tool or a pneumatic tool. An outer periphery of a second end of the shaft (71) has four cutting surfaces (74) to form a connecting end (75) with a rectangular cross section. Since an external diameter of connecting end (75) is smaller than the shaft (71), a flange (76) is formed at a connecting edge between the shaft (71) and the connecting end (75). Moreover, a locating ball (77) is mounted on an outer surface of the connecting end (75), and a magnetic unit (78) is secured at a front end thereof. A first peripheral groove (79) formed at an outer periphery of the shaft (71) is located adjacent to the flange (76). A circular connecting opening (81) and a tool slot (82) with a rectangular cross section are respectively and axially formed at a rear end and a front end of the sliding sleeve (80), and an inner blocking edge (83) is formed at a connecting edge between the connecting opening (81) and the tool slot (82). Also, a second peripheral groove (84) is formed at an inner periphery of the connecting opening (81), and each of inner edges of the tool slot (82) has a V-shaped groove (85). After the C-shaped fastener (90) is engaged with the first peripheral groove (79), the sliding sleeve (80) is connected to the shaft (71) through the connecting opening (81) such that the C-shaped fastener (90) is configured to engage with the first peripheral groove (79) and the second peripheral groove (84) simultaneously. Furthermore, since the inner blocking edge (83) and the flange (83) are configured to bear against each other so as to limit the sliding displacement of the sliding sleeve (80) on the connecting rod (70). In actual application, by pushing the sliding sleeve (80) rearward, the connecting end (75) is configured to protrude from a front end of the tool slot (82) thereby connecting a tool socket (as shown in FIG. 11). Meanwhile, since the inner blocking edge (83) is borne against the flange (76) when the sliding sleeve (80) moved rearward thus stopping the displacement of the sliding sleeve (80). Otherwise, when the sliding sleeve (80) is moved forward (as shown in FIG. 12), the connecting end (75) is completely received inside the tool slot (82) such that the tool slot (82) is configured to has a housing space to receive a tool head and the V-shaped grooves (85) are configured to engage with each outer edges of the tool head. As a result, the connecting rod (70) is configured to drive and rotate the tool head. Also, when the sliding sleeve (80) is moved forward, the C-shaped fastener (90) is configured to engage with the first peripheral groove (79) and the second peripheral groove (84) simultaneously thus limiting the maximum displacement of the sliding sleeve (80).

However, the conventional tool assembly for screwdriver with detachable drill bits is disadvantageous because: the application thereof is limited by the use of the C-shaped fastener (90) and positions of the first peripheral groove (79) and the second peripheral groove (84), the sliding sleeve (80) and the connecting end (75) need to be elongated to adjust a sliding distance of the sliding sleeve (80) on the connecting rod (70) which increases the manufacturing cost and further reduces the competitive advantage in the market. Therefore, there remains a need for a new and improved design for a tool assembly for screwdriver with detachable drill bits to overcome the problems presented above.

SUMMARY OF THE INVENTION

The present invention provides a tool assembly for screwdriver with quick-release drill bits, which comprises a bit main body, a sliding sleeve, a spring and a locating bolt. The bit main body has a circular shaft, and an outer periphery of a front end of the shaft has four axial cutting surfaces to form a connecting portion with a rectangular cross section. An external diameter of the connecting portion is smaller than the shaft such that a flange is formed at a connecting edge between the shaft and the connecting portion. Also, the connecting portion comprises a locating ball and a housing hole respectively mounted on and penetrating through the connecting portion. Furthermore, a magnetic unit is secured on a front end of the connecting portion when needed. The sliding sleeve comprises a rear end and a front end which are respectively close to and away from the bit main body, and a driving hole with a rectangular cross section axially penetrates through the sliding sleeve. An engaging groove formed at an inner periphery of the driving hole is located adjacent to the rear end of the sliding sleeve, and a guiding surface is located between a front end of the driving hole and the engaging groove. In addition, each of inner edges of the driving hole has a V-shaped groove formed at a central portion thereof. After putting the spring and the locating bolt into the housing hole of the bit main body, the sliding sleeve is connected to the connecting portion of the bit main body through the driving hole. The spring is configured to push the locating bolt into the engaging groove, and the rear end of the sliding sleeve and the flange are configured to bear against each other, so that the maximum sliding displacement of the sliding sleeve on the bit main body is limited.

Comparing with conventional tool assembly for screwdriver with detachable drill bits, the present invention is advantageous because: the design of the spring, the locating bolt and the engaging groove are configured to effectively shorten lengths of the connecting portion of the bit main body and the sliding sleeve thus lowering the manufacturing cost and increasing the competitive advantage in the market.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
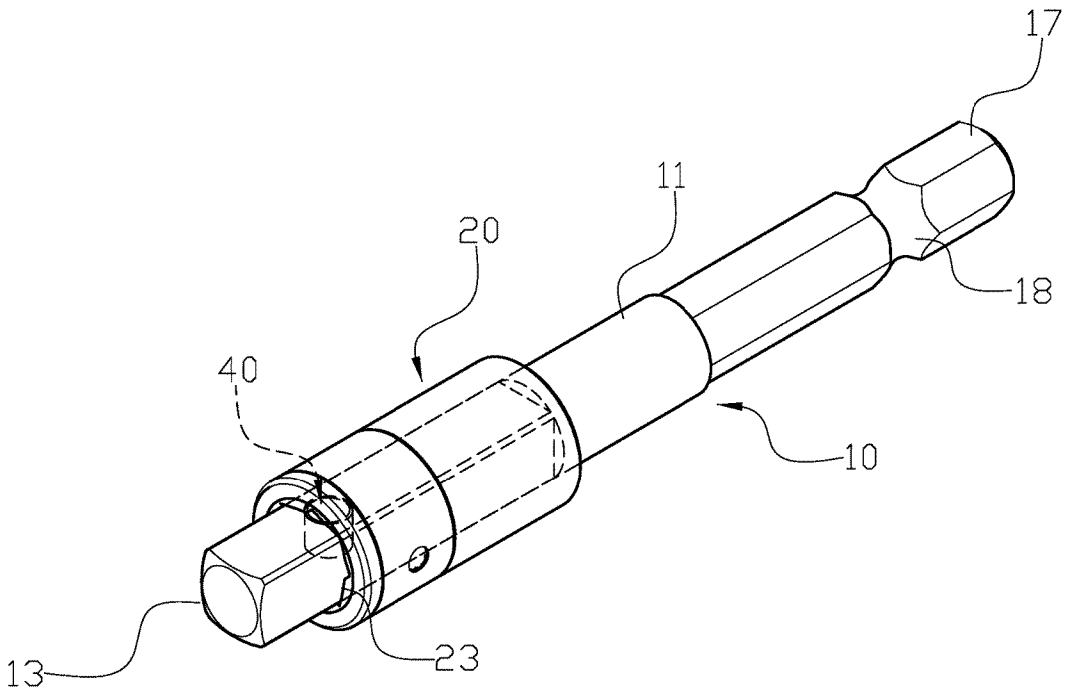
FIG. 1 is a three-dimensional assembly view of a tool assembly for screwdriver with quick-release drill bits in the present invention.
Figure 2:
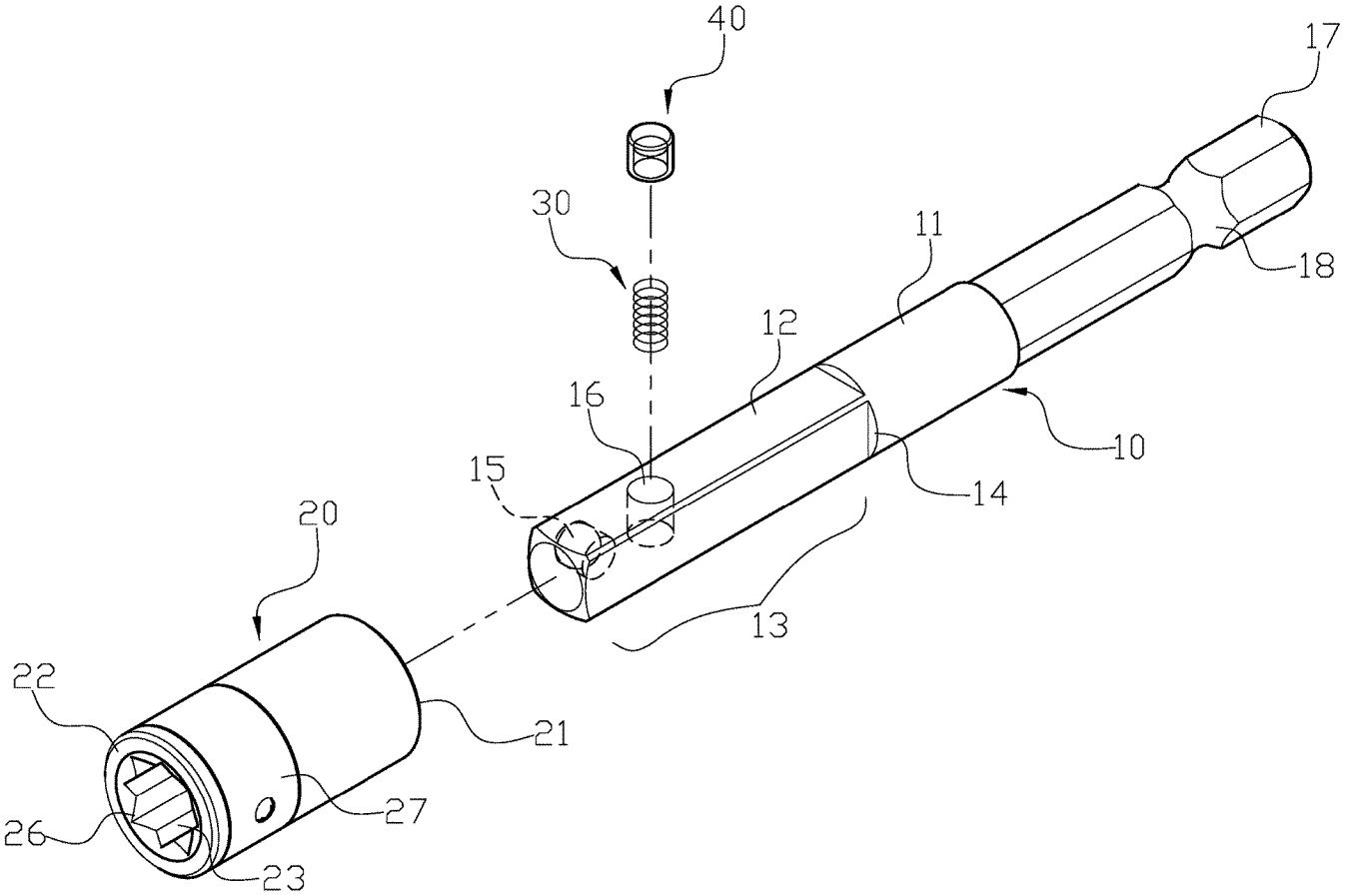
FIG. 2 is a three-dimensional exploded view of the tool assembly for screwdriver with quick-release drill bits in the present invention.
Figure 3:
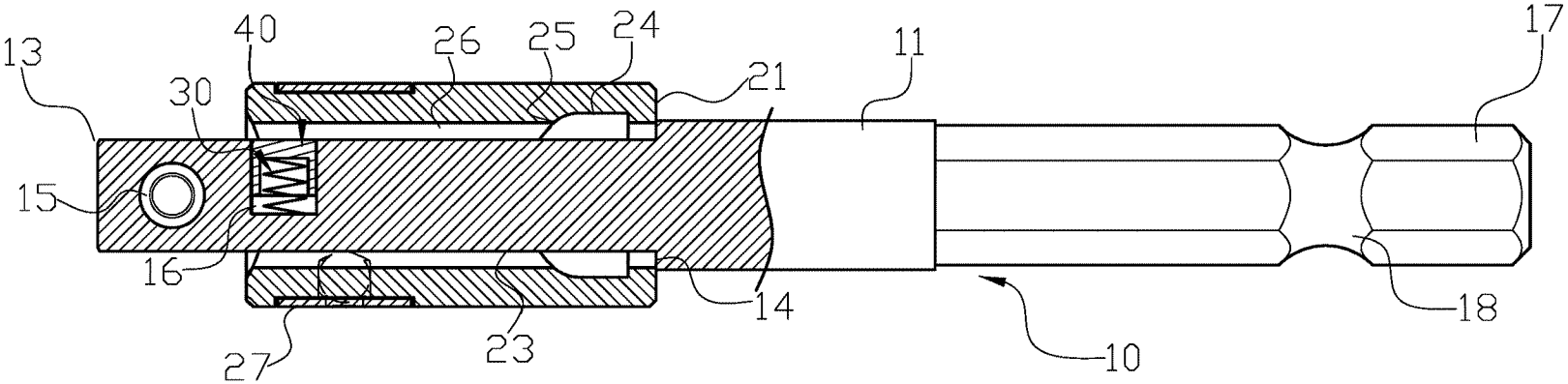
FIG. 3 is a sectional assembly view of the tool assembly for screwdriver with quick-release drill bits in the present invention.

In order to further understand the goal, characteristics and effect of the present invention, a number of embodiments along with the drawings are illustrated as following:

Referring to FIGS. 1 to 3, the present invention provides a tool assembly for screwdriver with quick-release drill bits, which comprises a bit main body (10), a sliding sleeve (20), a spring (30) and a locating bolt (40). The bit main body (10) has a circular shaft (11), and an outer periphery of a front end of the shaft (11) has four axial cutting surfaces (12) to form a connecting portion (13) with a rectangular cross section. An external diameter of the connecting portion (13) is smaller than the shaft (11) such that a flange (14) is formed at a connecting edge between the shaft (11) and the connecting portion (13). Also, the connecting portion (13) comprises a locating ball (15) and a housing hole (16) respectively mounted on and penetrating through the connecting portion (13). Furthermore, a magnetic unit (13) is secured on a front end of the connecting portion (13) when needed. The sliding sleeve (20) comprises a rear end (21) and a front end (22) which are respectively close to and away from the bit main body (10), and a driving hole (23) with a rectangular cross section axially penetrates through the sliding sleeve (20). An engaging groove (24) formed at an inner periphery of the driving hole (23) is located adjacent to the rear end (21) of the sliding sleeve (20), and a guiding surface (25) is located between a front end of the driving hole (23) and the engaging groove (24). In addition, each of inner edges of the driving hole (23) has a V-shaped groove (26) formed at a central portion thereof. After putting the spring (30) and the locating bolt (40) into the housing hole (16) of the bit main body (10), the sliding sleeve (20) is connected to the connecting portion (13) of the bit main body (10) through the driving hole (23). The spring (30) is configured to push the locating bolt (40) into the engaging groove (24), and the rear end (21) of the sliding sleeve (20) and the flange (14) are configured to bear against each other, so that the maximum sliding displacement of the sliding sleeve (20) on the bit main body (10) is limited.

In one embodiment, a rear end of the shaft (11) has a first engaging portion (17) with a hexagonal cross section, and a peripheral groove (18) is formed at an outer periphery thereof such that the shaft (11) is configured to connect to an electric tool or a pneumatic tool through the first engaging portion (17).

Figure 4:
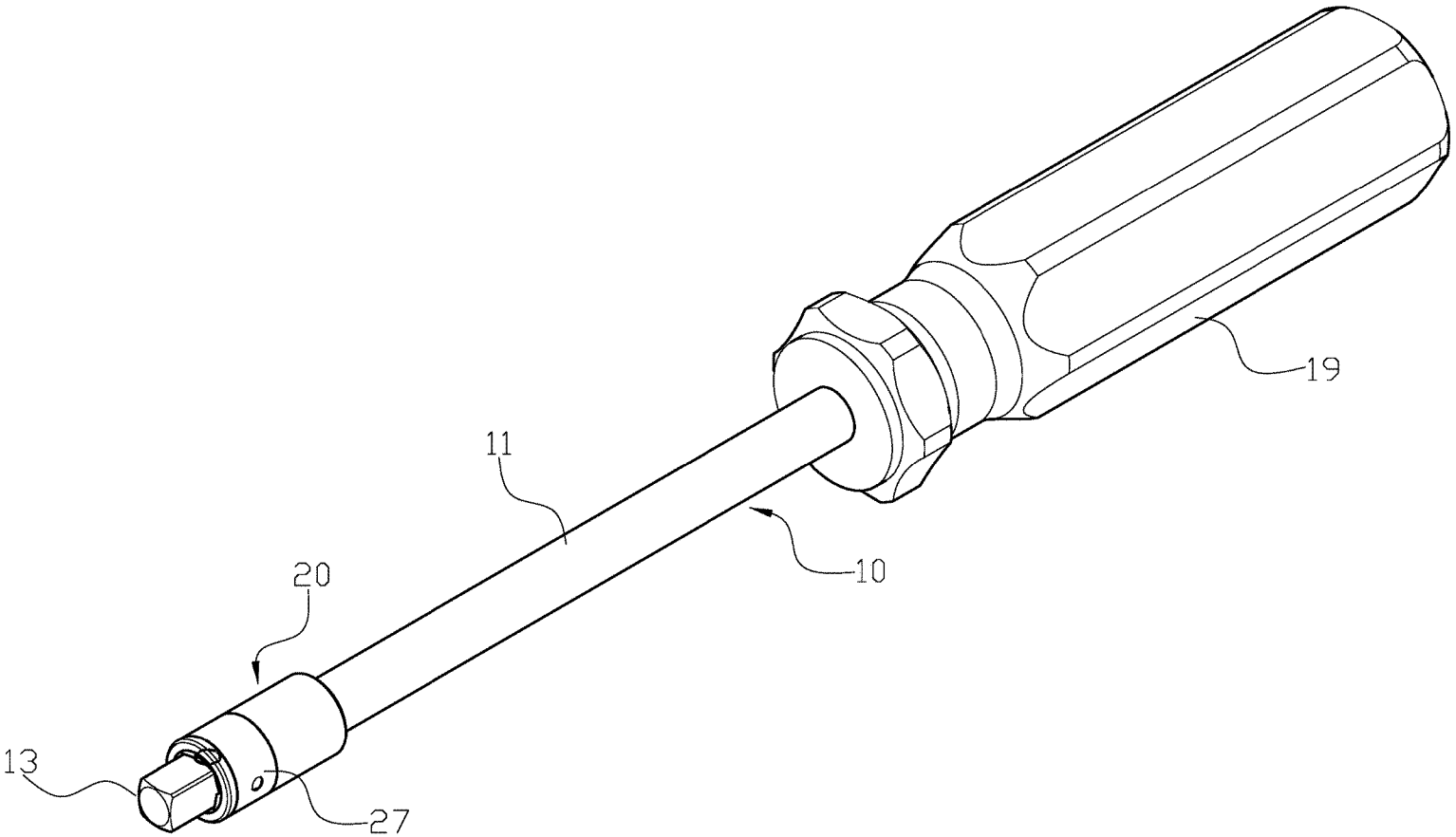
FIG. 4 is a schematic view illustrating the tool assembly for screwdriver with quick-release drill bits in the present invention is connected to a handle.

In another embodiment, the rear end of the shaft (11) is configured to directly connect to a handle (19) (as shown in FIG. 4).

In still another embodiment, the locating bolt (40) has an opening which is configured to receive the spring (30) such that an end of the spring (30) is configured to axially bear against an inner surface of the locating bolt (40).

In a further embodiment, a locating piece mounted on the sliding sleeve (20) is located adjacent to the front end (22) of the sliding sleeve (20), and an elastic piece (27) covers around an outer periphery of the sliding sleeve (20) at a position corresponding to the locating piece.

Figure 5:
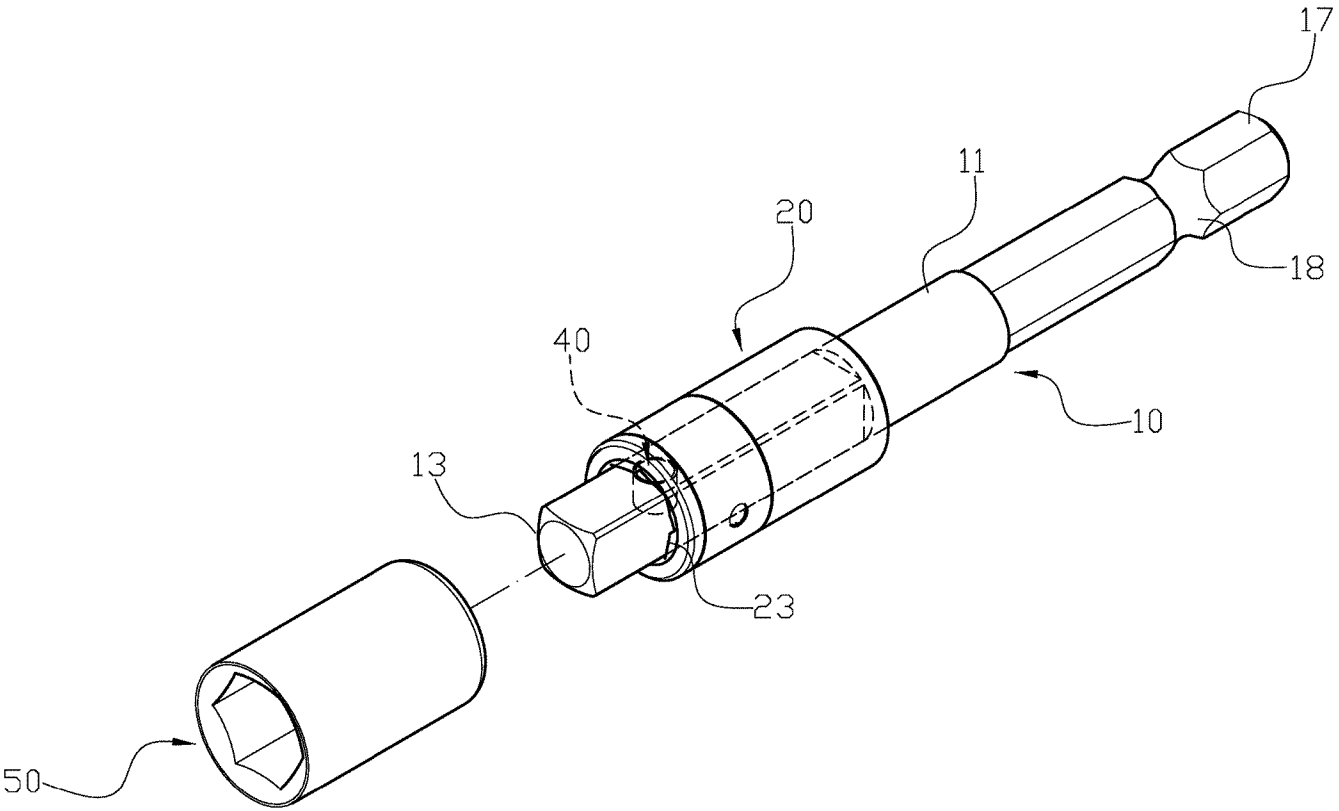
FIG. 5 is a schematic view illustrating the tool assembly for screwdriver with quick-release drill bits in the present invention is connected to a tool socket.
Figure 6:
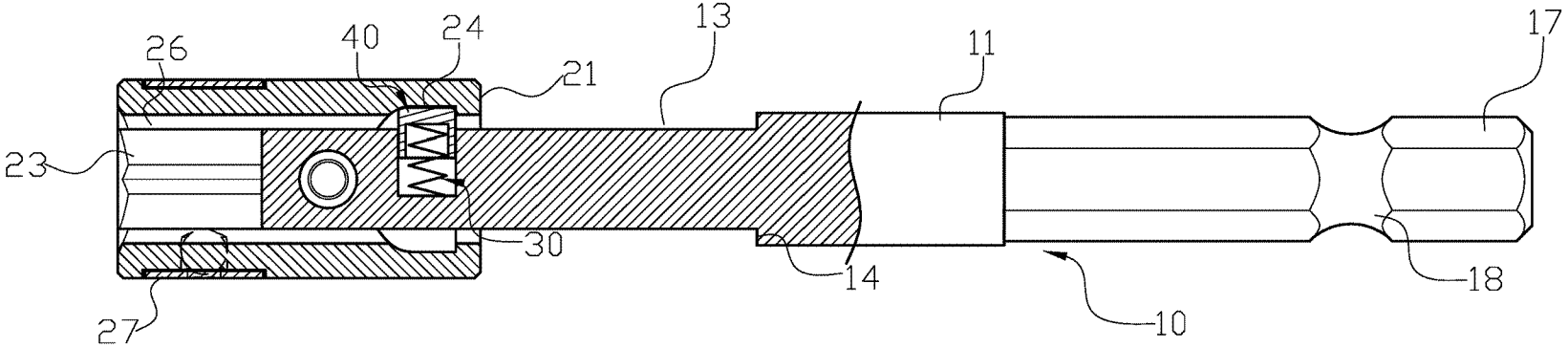
FIG. 6 is a sectional view illustrating a sliding sleeve of the tool assembly for screwdriver with quick-release drill bits in the present invention is pushed forward.
Figure 7:
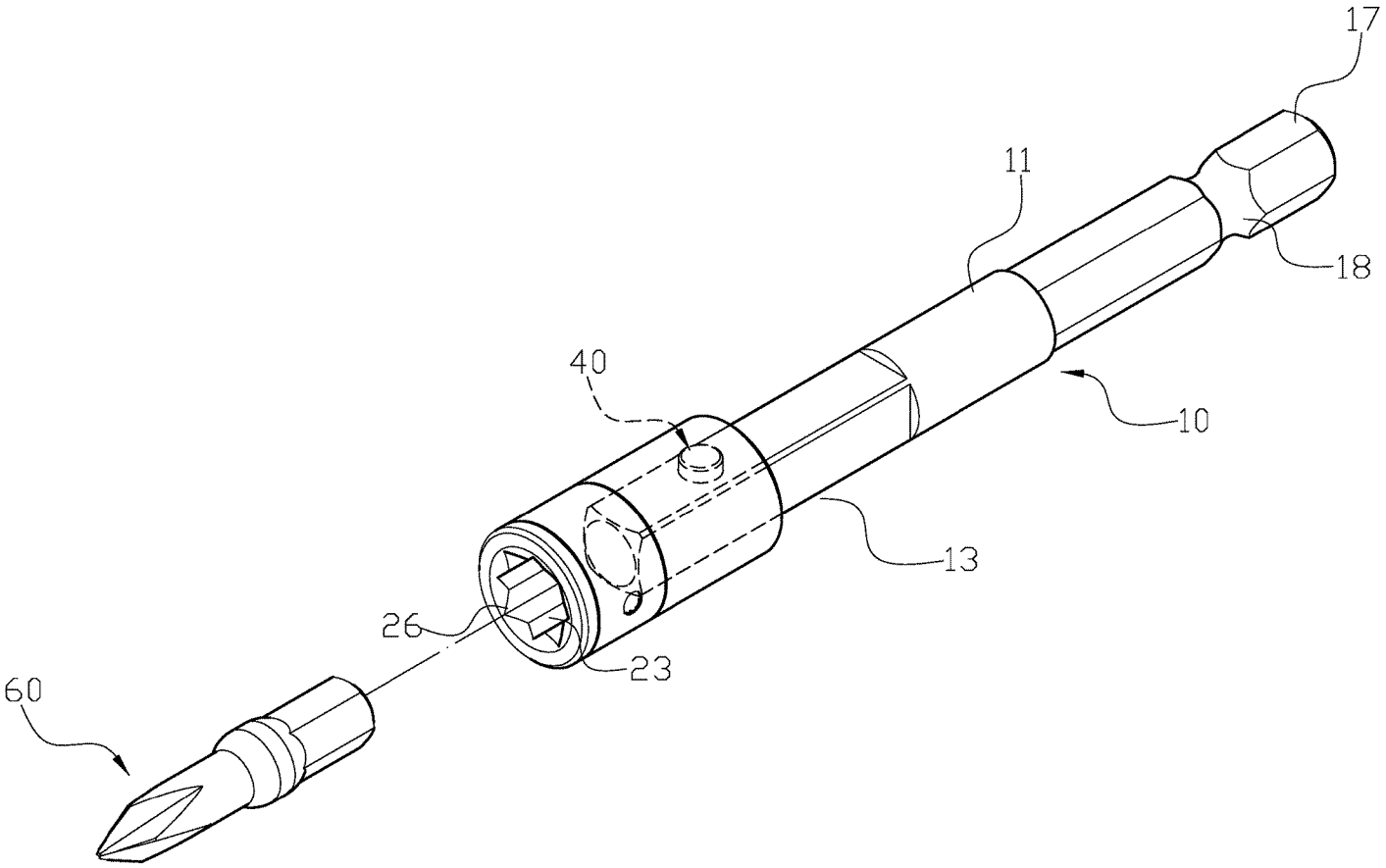
FIG. 7 is a schematic view illustrating the tool assembly for screwdriver with quick-release drill bits in the present invention is connected to a tool head after the sliding sleeve is pushed forward.
Figure 8:
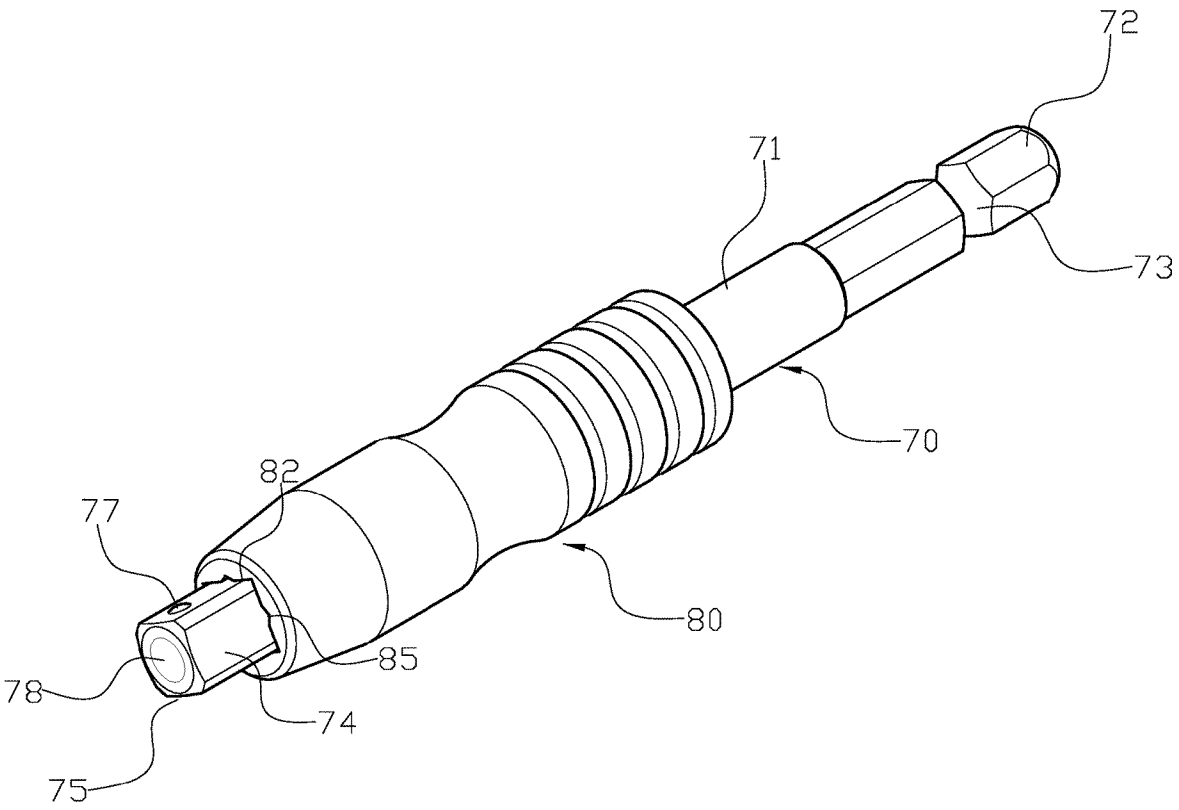
FIG. 8 PRIOR ART
FIG. 8 is a prior art.
Figure 9:
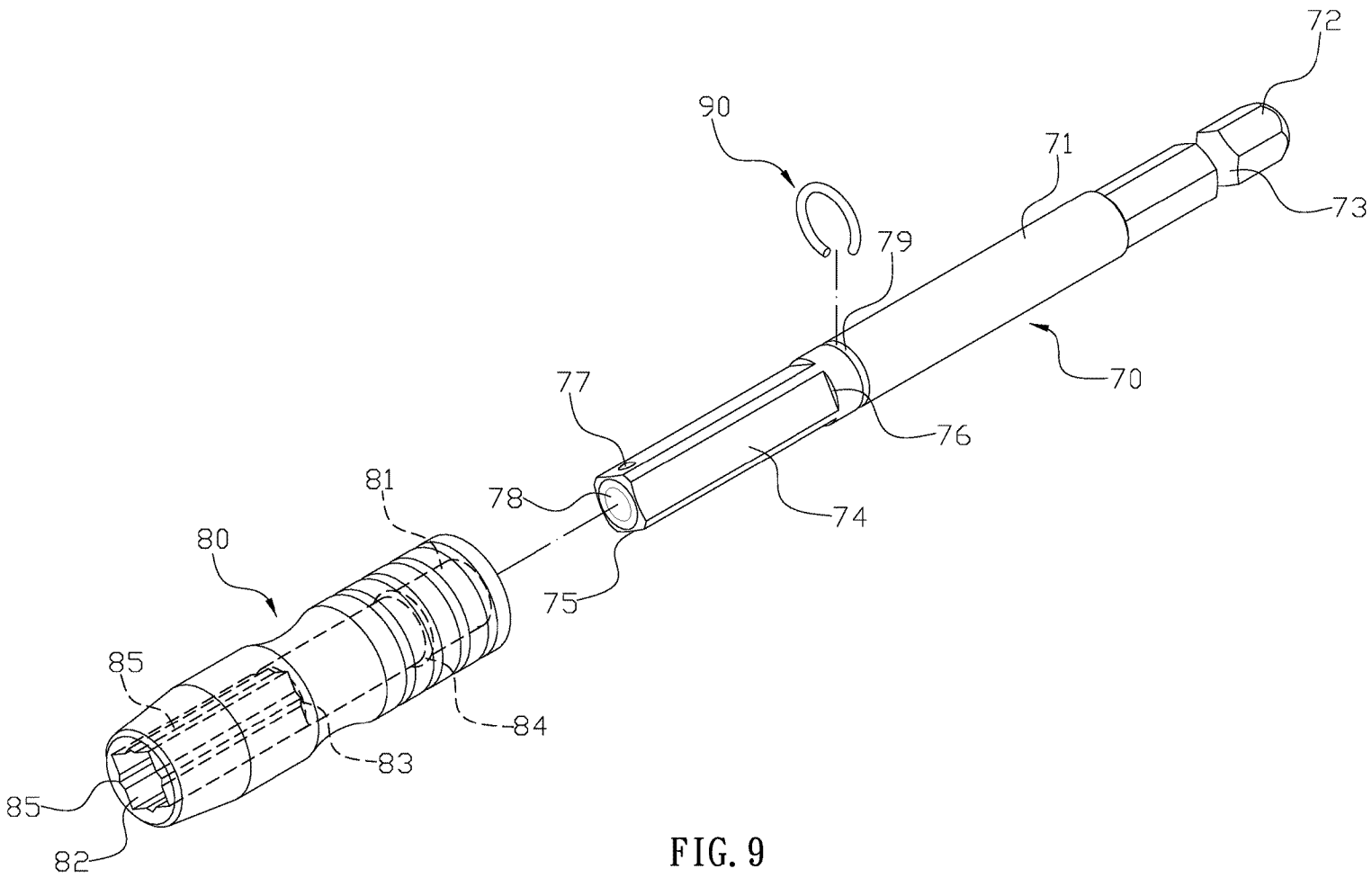
FIG. 9 PRIOR ART
FIG. 9 is a prior art.
Figure 10:
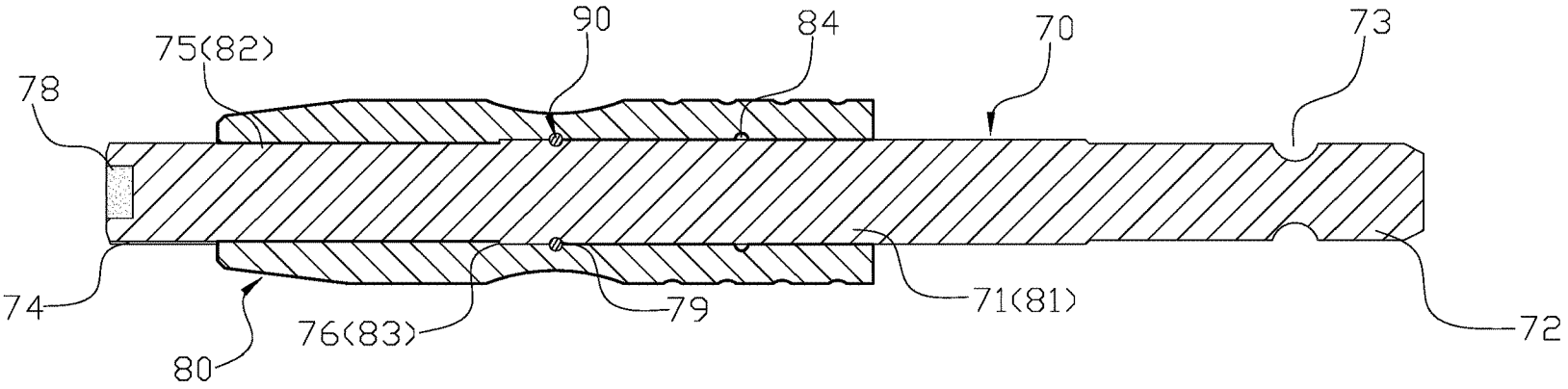
FIG. 10 PRIOR ART
FIG. 10 is a prior art.
Figure 11:
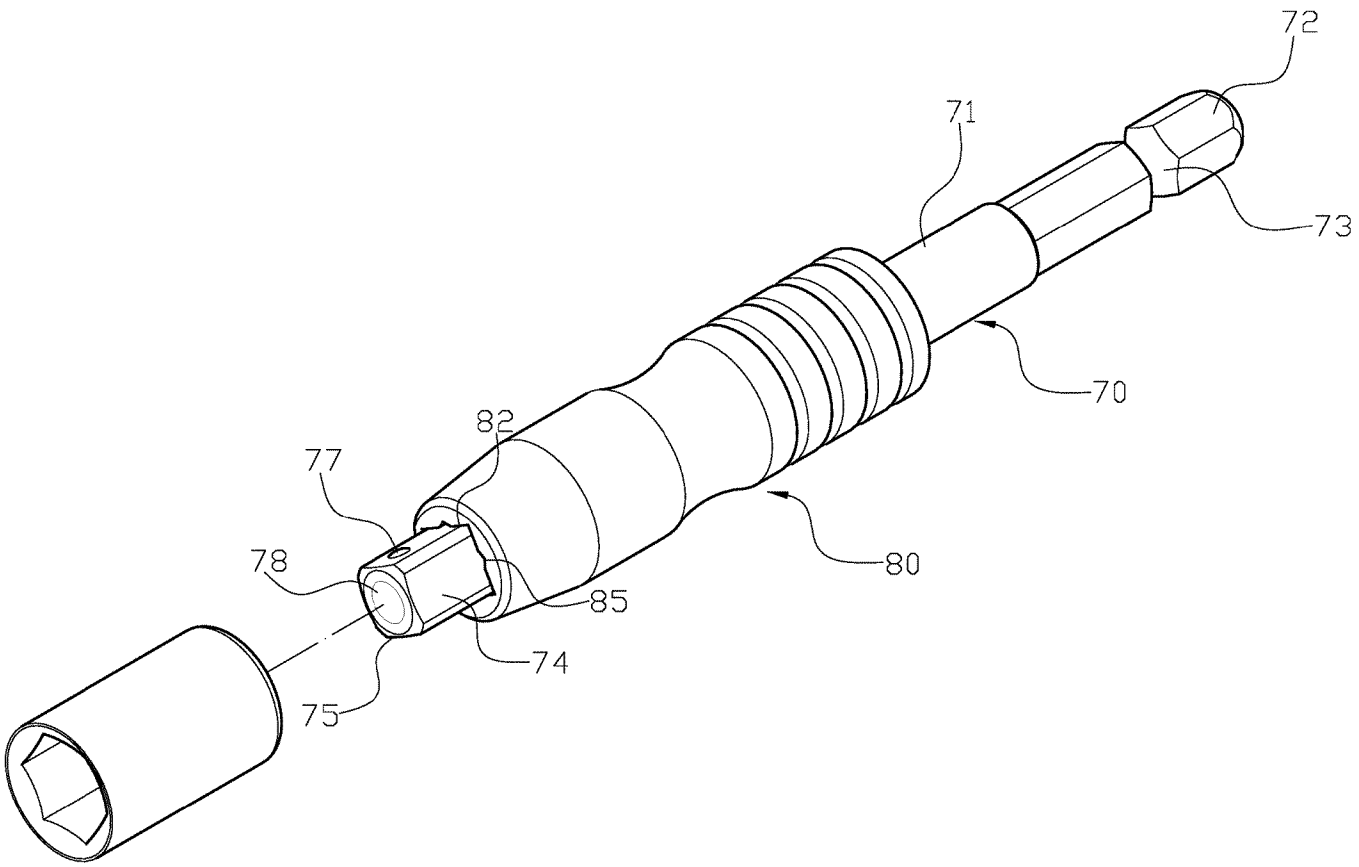
FIG. 11 PRIOR ART
FIG. 11 is a prior art.
Figure 12:
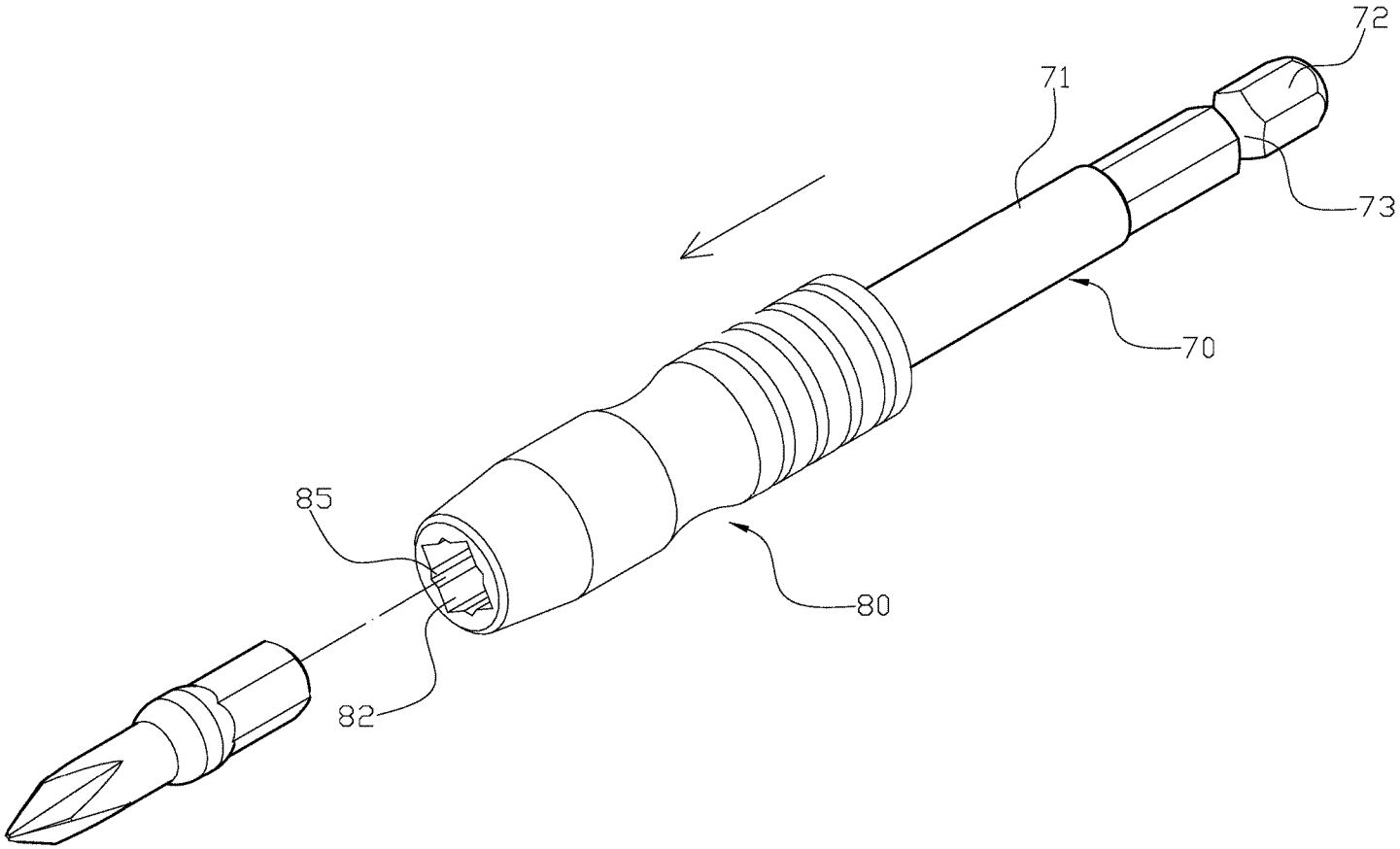
FIG. 12 PRIOR ART
FIG. 12 is a prior art.

Referring to FIG. 5, in actual application, by pushing the sliding sleeve (20) rearward, the connecting portion (13) of the bit main body (10) is configured to protrude from a front end of the driving hole (23) thereby connecting a tool socket (50). Meanwhile, the rear end (21) of the sliding sleeve (20) is configured to bear against the flange (14) thereby stopping the sliding displacement of the sliding sleeve (20). Conversely, when the sliding sleeve (20) is moved forward (as shown in FIGS. 6 and 7), the connecting portion (13) of the bit main body (10) is completely received inside the driving hole (23) such that a housing space is formed inside the driving hole (23) to receive a tool head (60). Meanwhile, the locating bolt (40) pushed by the spring (30) is configured to engage with the engaging groove (24) thus limiting the maximum sliding displacement of the sliding sleeve (20).

Comparing with conventional tool assembly for screwdriver with quick-release bits, the present invention is advantageous because: the design of the spring (30), the locating bolt (40) and the engaging groove (24) are configured to effectively shorten lengths of the connecting portion (13) of the bit main body (10) and the sliding sleeve (20) thus lowering the manufacturing cost and increasing the competitive advantage in the market.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A tool assembly for screwdriver with quick-release drill bits comprising:

a bit main body having a shaft, and an outer periphery of a front end thereof comprising a plurality of axial cutting surfaces to form a connecting portion with a polygonal cross section, and an external diameter of the connecting portion being smaller than the shaft such that a flange formed at a connecting edge between the shaft and the connecting portion, and a housing hole penetrating through an outer surface of the connecting portion;

a sliding sleeve comprising a rear end and a front end which are respectively close to and away from the main body, and a driving hole with a polygonal cross section axially penetrating through the sliding sleeve, and a substantially wedge-shaped engaging groove, which is formed at an inner periphery of the driving hole, located adjacent to the rear end of the sliding sleeve, and a guiding surface located between a front end of the driving hole and the engaging groove; and a spring and a locating bolt sequentially put into the housing hole of the main body, and the sliding sleeve connected to the connecting portion of the main body through the driving hole; wherein when the locating bolt is pushed into the substantially wedge-shaped engaging groove by the spring, the rear end of the sliding sleeve and the flange are configured to bear against each other, thereby limiting the maximum sliding displacement of the sliding sleeve on the main body.

2. The tool assembly for screwdriver with quick-release drill bits of claim 1, wherein the shaft of the main body has a circular cross section.

3. The tool assembly for screwdriver with quick-release drill bits of claim 1, wherein the connecting portion of the main body comprises a rectangular cross section and the driving hole has a rectangular inner cross section.

4. The tool assembly for screwdriver with quick-release drill bits of claim 1, wherein a locating ball is mounted on the connecting portion of the main body.

5. The tool assembly for screwdriver with quick-release drill bits of claim 1, wherein a magnetic unit is secured on a front end of the connecting portion of the main body.

6. The tool assembly for screwdriver with quick-release drill bits of claim 1, wherein a rear end of the shaft has a first engaging portion with a hexagonal cross section, and a peripheral groove is formed at an outer periphery of the first engaging portion.

7. The tool assembly for screwdriver with quick-release drill bits of claim 1, wherein the rear end of the shaft is configured to directly connect to a handle.

8. The tool assembly for screwdriver with quick-release drill bits of claim 1, wherein each of inner edges of the driving hole has a V-shaped groove formed at a central portion thereof.

9. The tool assembly for screwdriver with quick-release drill bits of claim 1, wherein a locating piece mounted on the sliding sleeve is located adjacent to the front end of the sliding sleeve, and an elastic piece covers around an outer periphery of the sliding sleeve at a position corresponding to the locating piece.

10. The tool assembly for screwdriver with quick-release drill bits of claim 1, wherein the locating bolt has an opening which is configured to receive the spring such that an end of the spring is configured to axially bear against an inner surface of the locating bolt.

* * * * *